US012484707B1

(12) United States Patent
Liang et al.

(10) Patent No.: US 12,484,707 B1
(45) Date of Patent: Dec. 2, 2025

(54) INFLATABLE BED

(71) Applicant: Reestar International Limited, Hong Kong (CN)

(72) Inventors: Gaoming Liang, Hong Kong (CN); Xinju Yang, Hong Kong (CN); Xili Wu, Hong Kong (CN); Chakfu Yu, Hong Kong (CN)

(73) Assignee: Reestar International Limited, Hong Kong (CN)

( * ) Notice: Subject to any disclaimer, the term of this patent is extended or adjusted under 35 U.S.C. 154(b) by 0 days.

(21) Appl. No.: 19/190,897

(22) Filed: Apr. 28, 2025

(30) Foreign Application Priority Data

Mar. 14, 2025 (CN) ..... 202520454989.7

(51) Int. Cl.
*A47C 27/08* (2006.01)

(52) U.S. Cl.
CPC ..... *A47C 27/087* (2013.01); *A47C 27/081* (2013.01)

(58) Field of Classification Search
CPC ..... A47C 27/087; A47C 27/081
USPC ..... 5/712
See application file for complete search history.

(56) References Cited

U.S. PATENT DOCUMENTS

| | | | | |
|---|---|---|---|---|
| 4,399,575 | A * | 8/1983 | Hall | A47C 27/085 5/684 |
| 4,662,012 | A * | 5/1987 | Torbet | A47C 27/087 5/713 |
| 5,490,295 | A * | 2/1996 | Boyd | A47C 27/087 5/687 |
| 11,564,505 | B2 * | 1/2023 | Liu | A47C 27/16 |
| 12,108,880 | B2 | 10/2024 | Shi | |
| 12,279,700 | B2 * | 4/2025 | Ocegueda Gallaga | B29C 66/433 |
| 2005/0268402 | A1 * | 12/2005 | Weng | A47C 27/081 5/711 |
| 2006/0130240 | A1 * | 6/2006 | Hsu | A47C 27/081 5/712 |
| 2013/0145560 | A1 * | 6/2013 | Chen | A47C 27/082 5/711 |
| 2015/0201760 | A1 * | 7/2015 | Lin | A47C 27/087 5/710 |
| 2021/0259434 | A1 * | 8/2021 | Wang | A47C 27/10 |
| 2025/0072630 | A1 * | 3/2025 | Wang | A47C 27/081 |

* cited by examiner

*Primary Examiner* — Myles A Throop

(57) ABSTRACT

An inflatable bed includes a bed body and at least one tension band. The bed body has an inflation chamber and includes a first wall and a second wall which are arranged opposite to each other. The at least one tension band is located in the inflation chamber and include a first end, a second end, and at least one connecting section connected with each of the first end and the second end. The first end is connected to the first wall, and the second end is connected to the second wall. Each of the at least one connecting section is arranged with at least one narrow portion. A width of at least a portion of each of the at least one narrow portion is smaller than each of a width of the first end and a width of the second end.

19 Claims, 8 Drawing Sheets

INFLATABLE BED

CROSS REFERENCE TO RELATED APPLICATIONS

The present application claims the priority of the Chinese patent application No. 202520454989.7, filed on Mar. 14, 2025, contents of which are incorporated herein by its entireties.

FIELD

The present disclosure relates to the field of inflatable products, and more particularly, to an inflatable bed.

BACKGROUND

An inflatable bed is characterized by portability and flexible placement. By inflating the inflatable bed with gas, the inflatable bed expands in volume to form a bed structure for user to use. An interior of the inflatable bed typically includes two end walls which are arranged opposite to each other and tension bands connecting the two end walls. The tension bands serve to maintain a shape of the inflatable bed.

When subjected to pressure, the gas in the inflatable bed shifts, causing localized expansion. Once the pressure is removed, the gas redistributes evenly, and the compressed areas of the inflatable bed rebound. During the expansion and recovery process, the two end walls exert tension on the tension bands, which can easily cause connection points between the tension bands to tear or fused ends where the tension bands join the two end walls to separate.

SUMMARY

An inflatable bed is disclosed in the present disclosure. The inflatable includes a bed body and at least one tension band. The bed body defines an inflation chamber and includes a first wall and a second wall arranged opposite to the first wall. The at least one tension band is arranged in the inflation chamber. Each of the at least one tension band includes a first end, a second end, and at least one connecting section connected with each of the first end and the second end. The first end is connected to the first wall, and the second end is connected to the second wall. Each of the at least one connecting section has at least one narrow portion. A width of at least a portion of each of the at least one narrow portion is smaller than each of a width of the first end and a width of the second end.

BRIEF DESCRIPTION OF THE DRAWINGS

To provide a clearer illustration of the technical solutions in the embodiments of the present disclosure or in the related art, a brief introduction will be given to the drawings used in the description of the embodiments or the related art. It is obvious that the drawings described below are merely some embodiments of the present disclosure, and for those skilled in the art, other drawings can be obtained based on these drawings without creative efforts.

REFERENCE NUMERALS IN THE DRAWINGS

Figure 1:
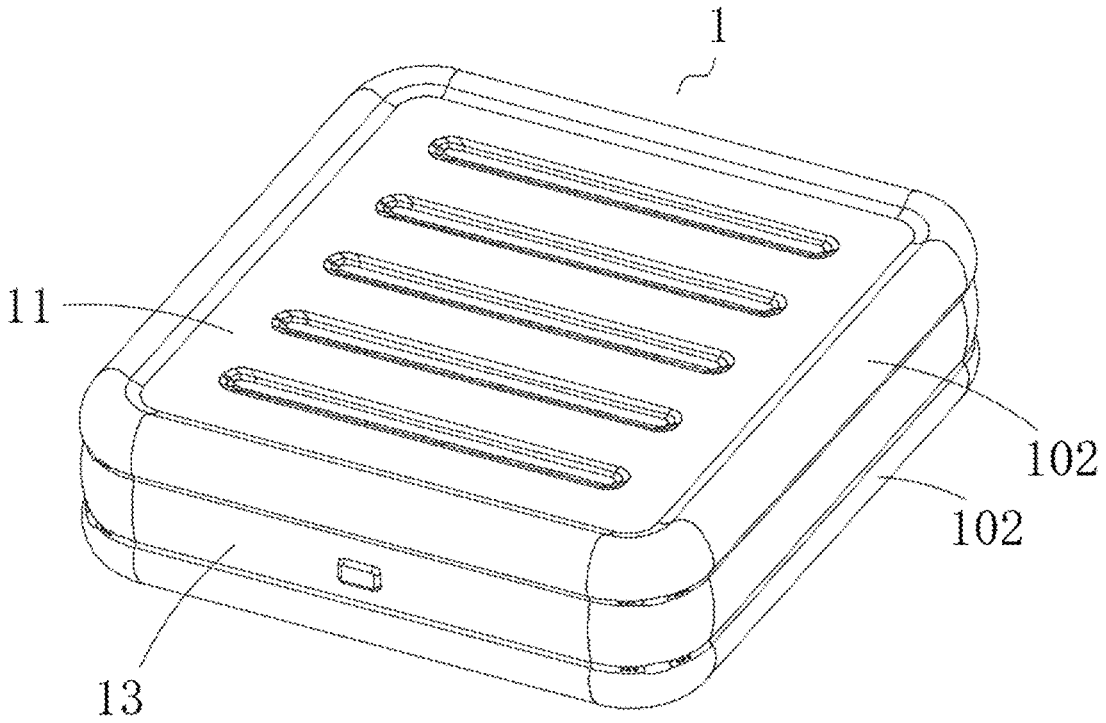
FIG. 1 is a structural view of an overall structure of an inflatable bed according an embodiment of the present disclosure.
Figure 2:
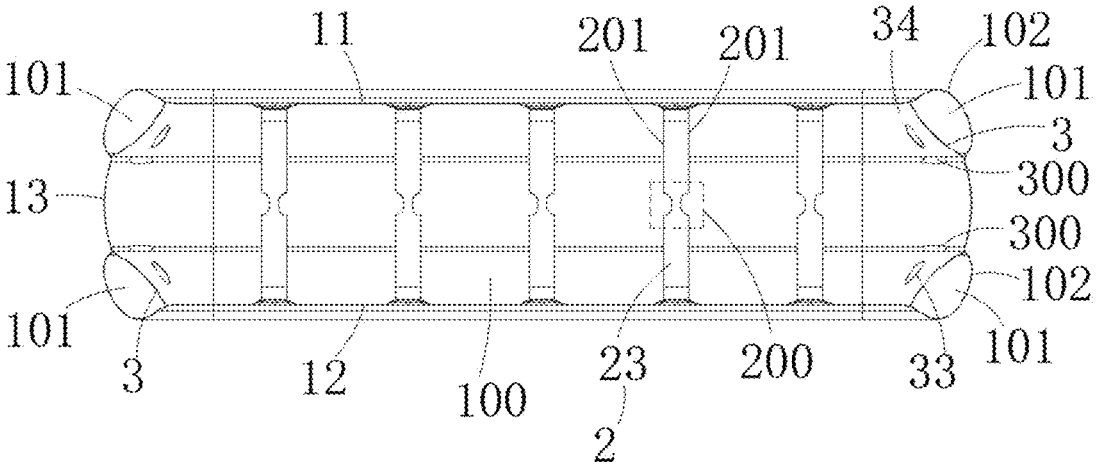
FIG. 2 is a first cross-sectional view of the inflatable bed according to an embodiment of the present disclosure, showing five tension bands in a bed body.

1—bed body; 11—first wall; 12—second wall; 13—enclosure wall; 100—inflation chamber; 101—secondary air cavity; 102—reinforcement airbag;

2—tension band; 21—first end; 22—second end; 23—connecting section; 200—narrow portion; 201—side edge; 231—middle portion; 2000—notch; 2001—upper half region; 2002—lower half region;

3—side band; 31—first connection edge; 32—second connection edge; 33—first communication opening; 34—corner portion; 300—second communication opening; 301—first connection seam; 302—second connection seam; 341—symmetrical central plane of the corner portion.

DETAILED DESCRIPTION

Unless otherwise defined, all technical and scientific terms used herein have the same meaning as commonly understood by those skilled in the art to which the present disclosure belongs. The terms used in the description of the present disclosure herein are intended for describing particular embodiments only and are not intended to limit the present disclosure. In the description, claims, and the above drawings of the present disclosure, the terms "including" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in conjunction with an embodiment may be included in at least one embodiment of the present disclosure. The appearance of the phrase at various places in the specification does not necessarily refer to the same embodiment, nor is it a separate or an alternative embodiment that is mutually exclusive of other embodiments. One skilled in the art would explicitly and implicitly understand that the embodiments described herein can be combined with other embodiments.

In order to enable those skilled in the art to better understand the technical solutions of the present disclosure, the technical solutions in the embodiments of the present disclosure will be clearly and completely described below with reference to the accompanying drawings.

Referencing FIGS. 1 to 8, an inflatable bed is disclosed in the present disclosure. The inflatable bed includes a bed body 1 and at least one tension band 2.

The bed body 1 has an inflation chamber 100 and includes a first wall 11, a second wall 12, and an enclosure wall 13. The first wall 11 and the second wall 12 are arranged opposite to each other. The enclosure wall 13 is connected with each of the first wall 11 and the second wall 12. The first wall 11, the second wall 12, and the enclosure wall 13 cooperatively define the inflation chamber 100 which can be sealed. The enclosure wall 13 is fusion-connected to each of the first wall 11 and the second wall 12, which may be achieved by high-frequency pressing, welding, ultrasonic bonding, stitching, adhesion, or other means. At least one of the first wall 11, the second wall 12, and the enclosure wall 13 is arranged with an inflation/deflation valve. The inflation chamber 100 can be inflated to expand the bed body 1 and provide support through the inflation/deflation valve. When gas in the inflation chamber 100 is fully released, the bed body 1 can be folded to reduce volume for convenient storage.

The at least one tension band 2 is located in the inflation chamber 100 and is connected to each of the first wall 11 and the second wall 12 by the high-frequency pressing. Alternatively, the at least one tension band 2 may be fixed by hot-melt, adhesive bonding, ultrasonic welding, stitching, or pins.

Each of the at least one tension band 2 includes a first end 21 connected to the first wall 11, a second end 22 connected to the second wall 12, and at least one connecting section 23 connected to each of the first end 21 and the second end 22. The connecting section 23 extends from the first wall 11 toward the second wall 12 and has at least one narrow portion 200. The narrow portion 200 is designed with a reduced width in a width direction of the connecting section 23, making a width of the narrow portion 200 smaller than each of a width of the first end 21 and a width of the second end 22. The width direction of the connecting section 23 is indicated by arrow K in FIG. 3. The reduced-width design of the narrow portion 200 means that the width of the narrow portion 200 is intentionally decreased to distinguish the narrow portion 200 from other parts of the connecting section 23. As shown in FIG. 4, for example, the narrow portion 200 may have a waist-like constriction where a middle portion 231 of the narrow portion 200 is narrower. A length of the narrow portion 200 along the connecting section 23 is not limited, and the narrow portion 200 may extend to cover the entire connecting section 23 at maximum. A half of the narrow portion 200 facing the first end 21 is referred to as an upper half region 2001, while a half of the narrow portion 200 facing the second end 22 is referred to as a lower half region 2002. A width of the upper half region 2001 gradually increases toward the first end 21, while a width of the lower half region 2002 gradually increases toward the second end 22. Alternatively, as shown in FIG. 3, the narrow portion 200 may define a notch 2000, directly reducing the width of the narrow portion 200.

When the bed body 1 is subjected to pressure or begins to recover after removal of an external force, the first wall 11 and the second wall 12 simultaneously exert tension on the tension band 2, applying opposing vertical tensile forces at both ends of the tension band 2. Because the narrow portion 200 has a smaller width than other sections of the tension band 2, deformation at the narrow portion 200 is greater, effectively elongating the tension band 2, reducing a reactive force exerted by the tension band 2 on the first wall 11 and the second wall 12, thereby dispersing stress and minimizing likelihood of the tension band 2 detaching or breaking from the first wall 11 or second wall 12. In one embodiment, the first wall 11 is a top wall, and the second wall 12 is a bottom wall. In another embodiment, the first wall 11 is a left wall, and the second wall 12 is a right wall. The following description primarily refers to the embodiment where the first wall is the top wall and the second wall is the bottom wall.

Figure 3:
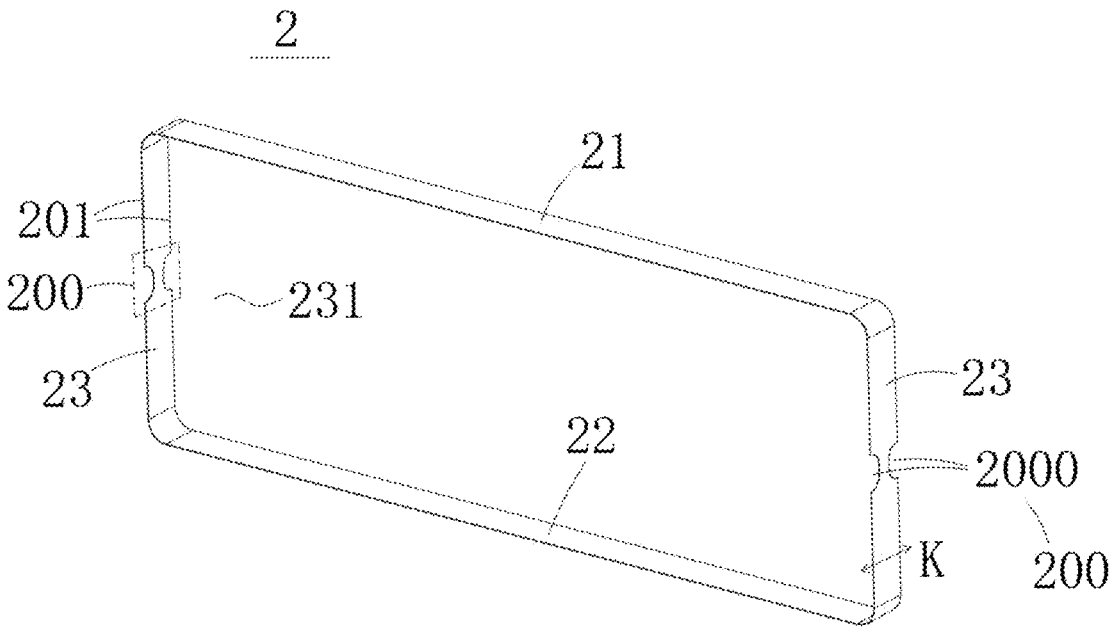
FIG. 3 is a structural view of a tension band according to an embodiment of the present disclosure, showing a narrow portion as a notch.
Figure 4:
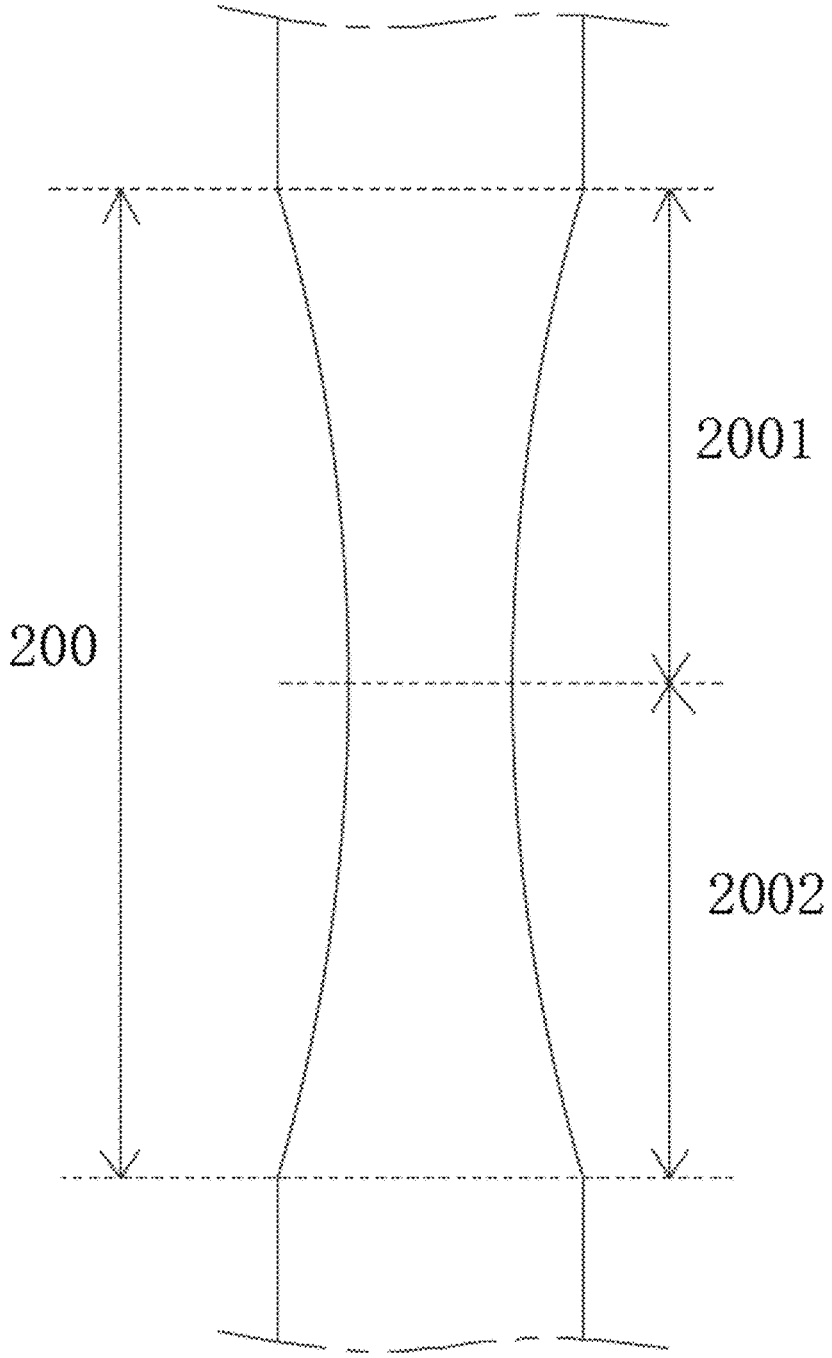
FIG. 4 is a structural view of the narrow portion according to another embodiment of the present disclosure.

Furthermore, referring to FIG. 3, a length of the first end 21 and a length of the second end 22 are not limited. Both the first end 21 and the second end 22 are bent perpendicularly to the connecting section 23. The first end 21 is connected to the first wall 11 via the high-frequency pressing, and the second end 22 is connected to the second wall 12 via the high-frequency pressing. The narrow portion 200 is formed on the connecting section 23, and the connecting section 23 is vertically arranged. The tensile force exerted by the first wall 11 and the second wall 12 on the tension band 2 is mainly concentrated on the connecting section 23.

Furthermore, since the tension band 2 is made of a highly flexible material such as nylon or woven bands, in this embodiment, a notch-type design for the narrow portion 200 to maximize elastic deformation of the tension band 2 is adopted. The narrow portion 200 has two notches 2000, one notch 2000 is formed on one of two side edges 201 of the connecting section 23 arranged opposite to each other and the other notch is formed on the other of the two side edges 201 of the connecting section 23. The two notches 2000 are symmetrically distributed in a mirror-image configuration. In this way, deformation of the tension band 2 can be concentrated at a same position along the connecting section 23, allowing the tension band 2 to undergo greater elongation and distributing more tensile force exerted on the first end 21 and second end 22.

Additionally, the narrow portion 200 is positioned at the middle portion 231 of the connecting section 23, ensuring that a distance between the narrow portion 200 and the first wall 11 is approximately equal to a distance between the narrow portion 200 and the second wall 12. Each of a central force application point from the first wall 11 on the connecting section 23 and a central force application point from the second wall 12 on the connecting section 23 is located at the middle portion 231. When the narrow portion 200 is arranged at the middle portion 231, the connecting section 23 becomes more prone to deformation under tension.

To further balance internal force distribution in the bed body 1, in this embodiment, each tension band 2 is arranged with two connecting sections 23. The two connecting sections 23, the first end 21, and the second end 22 cooperatively form a closed-loop structure for the tension band 2. Each of the two connecting sections 23 has a narrow portion 200. Specifically, each of the first end 21 and the second end 22 is distributed along a width direction of the bed body 1. The two connecting sections 23 are configured to balance force distribution on left and right sides of the bed body 1.

In another aspect, a plurality of tension bands 2 can be arranged at equal intervals along a width direction or along a length direction of the bed body 1, ensuring uniform force distribution along the length direction of the bed body 1 while maintaining structural aesthetics of the bed body 1.

For example, in one embodiment, each of the plurality of tension bands 2 includes only one first end 21, one second end 22, and one connecting section 23. The plurality of tension bands 2 are arranged in rows along the width direction of the bed body 1, forming a support assembly. Additionally, a plurality of support assemblies are distributed along the length direction of the bed body 1.

Referring to FIGS. 2 and 5-8, the inflatable bed further includes at least one side band 3. The at least one side band 3 is arranged in the inflation chamber 100 and arranged in a closed-loop structure. One of two side edges of the side band 3 refers to a first connection edge 31 and the other of the two side edges of the side band 3 refers to a second connection edge 32. The first connection edge 31 is connected to the enclosure wall 13, forming a first connection seam 301. The second connection edge 32 is connected to either the first wall 11 or the second wall 12, forming a second connection seam 302. The side band 3, at least a portion of the enclosure wall 13, and at least a portion of the first wall 11 cooperatively define a secondary air cavity 101. Alternatively, the side band 3, at least a portion of the enclosure wall 13, and at least a portion of the second wall 12 cooperatively define the secondary air cavity 101.

At least one first communication opening 33 is formed on the side band 3 and is configured to communicate the inflation chamber 100 and the secondary air cavity 101. When air is pumped into the inflation chamber 100, air flows through the first communication opening 33 into the secondary air cavity 101, thereby inflating the secondary air cavity 101. Due to tension exerted by the side band 3 on the enclosure wall 13 and the first wall 11 or second wall 12, after the secondary air cavity 101 expands, at least one reinforcement airbag 102 is formed along an edge of the bed body 1, helping maintain structural integrity of the bed body 1, preventing deformation after inflation. Particularly, two side bands 3 are provided. One of the two side bands 3 connects the enclosure wall 13 and the first wall 11, while the other of the two side bands 3 connects the enclosure wall 13 and the second wall 12. In this way, reinforcement airbags 102 are formed along both an edge of the first wall 11 and an edge of the second wall 12.

The bed body 1 may be arranged in various shapes, such as circular, frustum-shaped, rectangular, pentagonal, etc. In this embodiment, the bed body 1 is rectangular. The side band 3 has four inner corners corresponding to four edges of the bed body 1 which is rectangular. A corner portion 34 is formed at each inner corner of the side band 3. At least one first communication opening 33 is defined at least one corner portion 34 of the side band 3. In this way, air can flow between the inflation chamber 100 and the secondary air cavity 101 through the first communication opening 33 in the corner portion 34 at the inner corner, reducing the pressure of gas when it turns at locations with abrupt pressure changes. Particularly, each corner portion 34 of the side band 3 defines at least one first communication opening 33, ensuring uniform inflation of the bed body 1, thereby preventing localized air accumulation that could hinder airflow.

Figure 5:
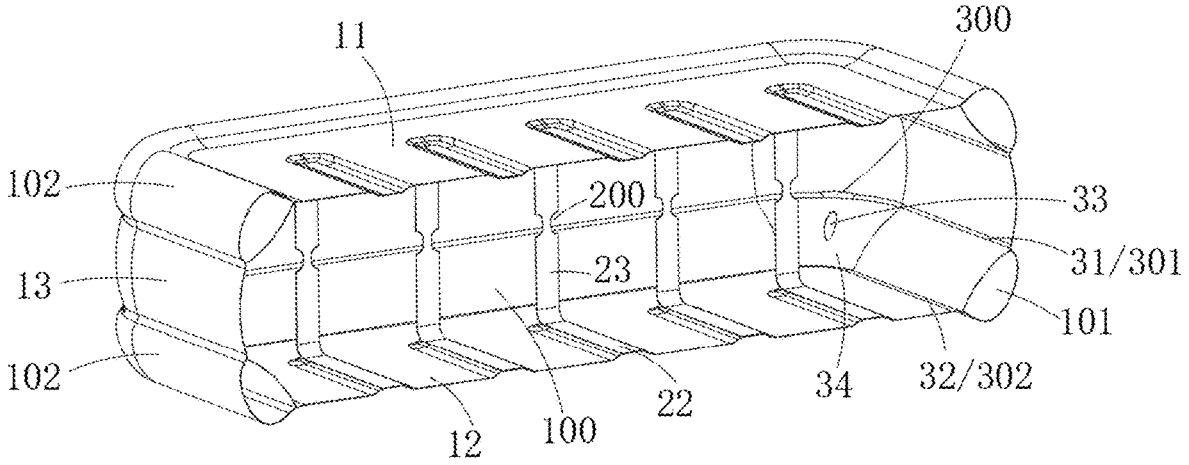
FIG. 5 is a second cross-sectional view of the inflatable bed according to an embodiment of the present disclosure, illustrating positions of a first communication opening and a second communication opening.

Referring to FIGS. 5, after the inflation chamber 100 and the secondary air cavity 101 are fully inflated, when the bed body 1 is subjected to pressure, the air in the secondary air cavity 101 will expand outward to surrounding areas of a pressure point, which may cause localized air accumulation, leading to a sharp increase in local pressure on the bed body 1 and the side band 3, and repeated localized pressure impact may affect service life of the inflatable bed, making the inflatable bed prone to unexpected damage. Therefore, in this embodiment, the first connecting edge 31 and the enclosing wall 13 are connected to form the first connecting seam 301, and the second connecting edge 32 is connected to the first wall 11 or the second wall 12 to form the second connecting seam 302. At least one second communication opening 300 is defined in at least one of the first connecting seam 301 and the second connecting seam 302. The second communication opening 300 communicates the inflation chamber 100 with the secondary air cavity 101 and is mainly disposed in areas prone to air accumulation, serving as a pressure relief mechanism to direct accumulated air back to the inflation chamber 100 and facilitate airflow circulation between the inflation chamber 100 and the secondary air cavity 101.

Figure 6:
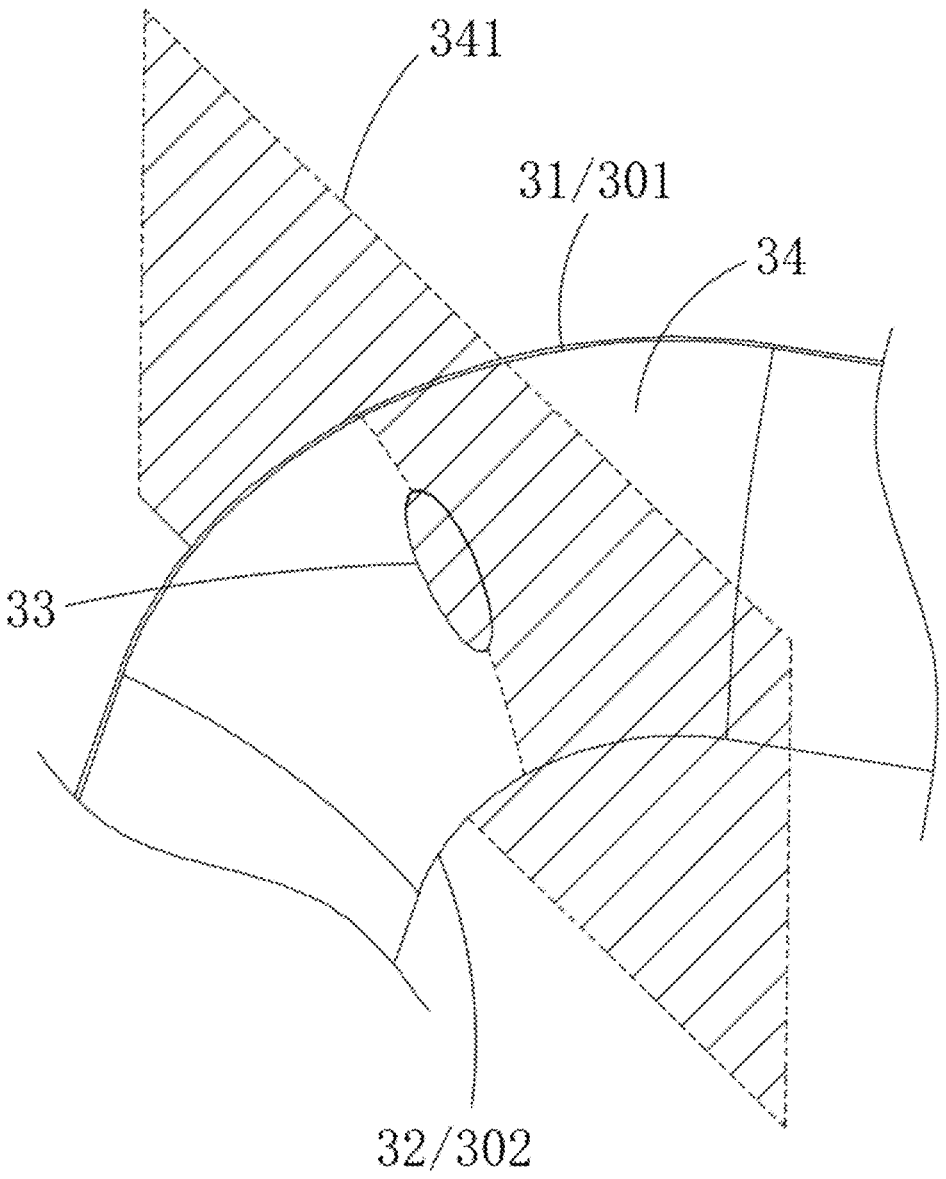
FIG. 6 is a schematic view of a symmetrical central plane of a corner portion according to an embodiment of the present disclosure.
Figure 7:
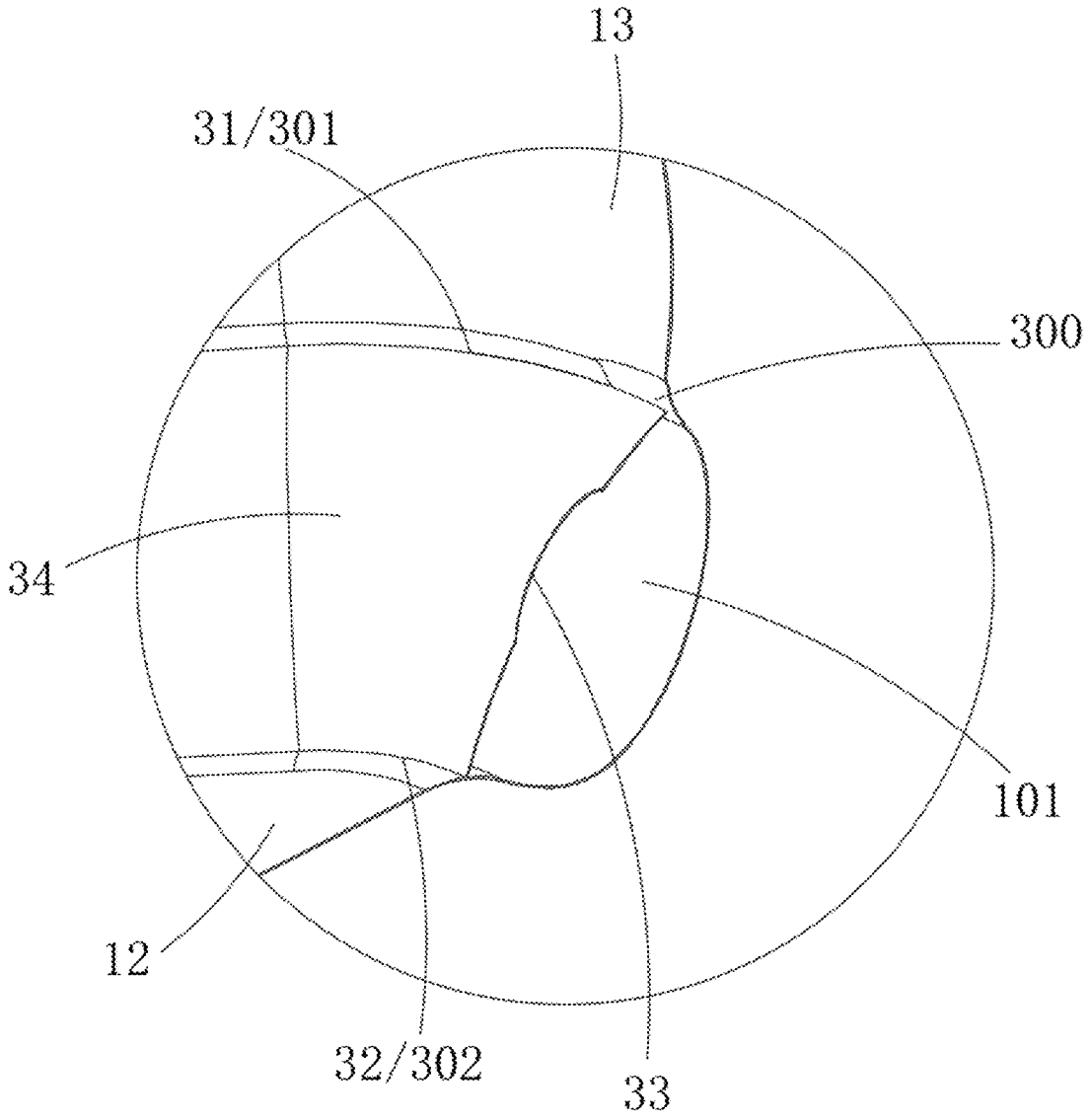
FIG. 7 is a cross-sectional view taken at the symmetrical central plane of the corner portion according to an embodiment of the present disclosure, showing communication relationship among an inflation chamber, a secondary air cavity, the first communication opening, and the second communication opening.
Figure 8:
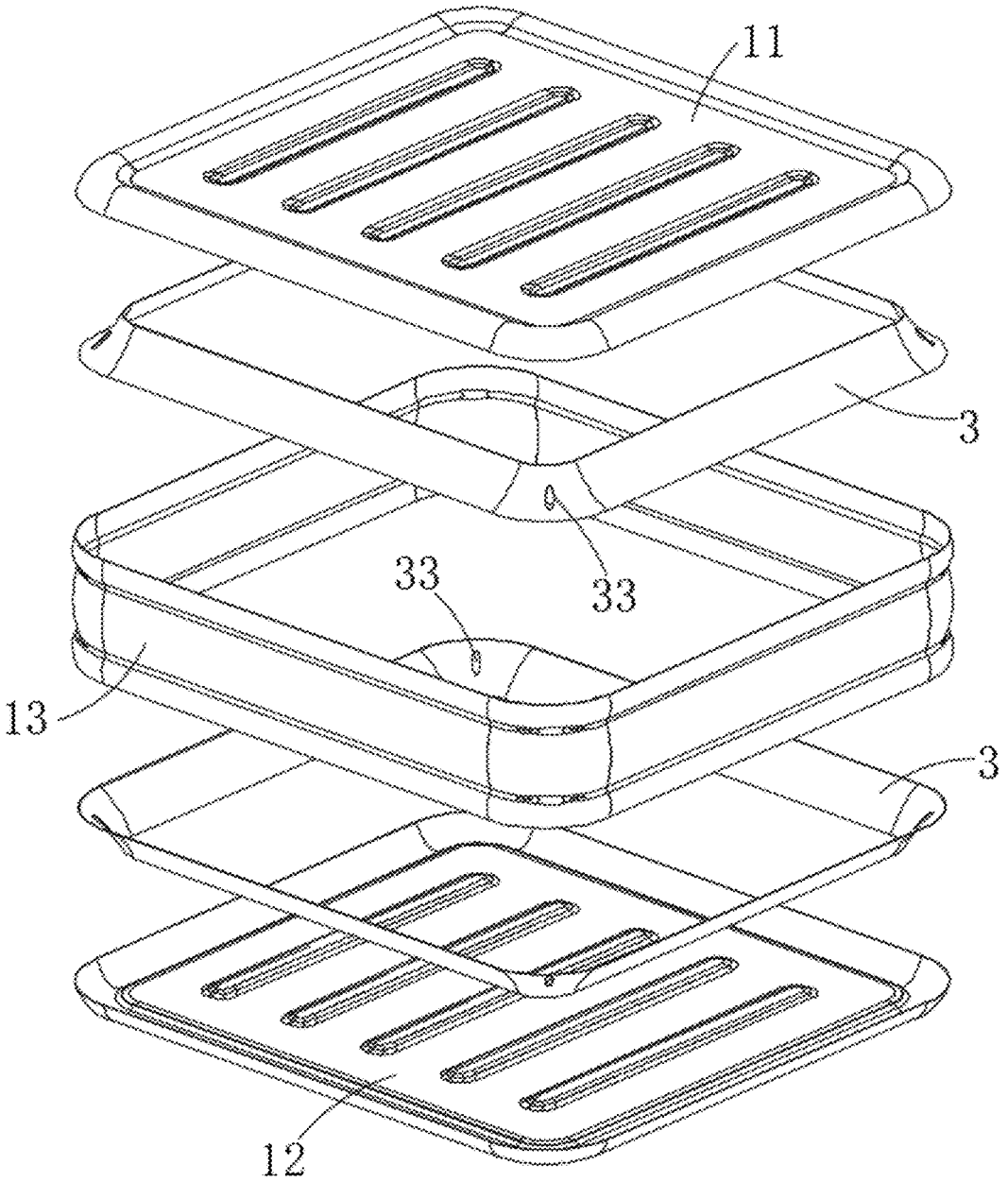
FIG. 8 is an exploded view of the bed body and two side bands according to an embodiment of the present disclosure.

As shown in FIGS. 5-7, the first communication opening 33 is in an elliptical shape and is located at a middle position of the corner portion 34. When the secondary air cavity 101 is fully inflated, due to the rectangular shape of the bed body 1, both the inflation chamber 100 and the secondary air cavity 101 on both sides of the corner portion 34 exert pressure on the corner portion 34. Therefore, by forming the first communication opening 33 at the middle position of the corner portion 34, the compressive force at the corner portion 34 can be alleviated, reducing risk of structural damage at the corner portion, thereby improving the service life of the bed body 1 while maintaining ergonomic design of the bed body 1. The corner portion 34 is arranged with an arc shape, and the middle position of the corner portion 34 specifically refers to an area near a symmetrical central plane 341 of the corner portion 34. At least one second communication opening 300 is defined in the first connecting seam 301, meaning that the second communication opening 300 is located on a side of the side band 3 facing a center of the bed body 1. Since the side band 3 has four corner portions 34 corresponding to the four edges of the bed body 1, the at least one second communication opening 300 is defined in at least one corner portion 34. Particularly, each corner portion 34 of the side band 3 defines at least one second communication opening 300. As airflow experiences turning pressure at the corners, air is most likely to accumulate in the secondary air cavity 101 near the corner portion 34. Therefore, defining the second communication opening 300 in the first connecting seam 301 corresponding to the corner portion 34 provides a highly efficient pressure relief effect. Furthermore, the second communication opening 300 extends through the symmetrical central plane 341 of the corner portion 34. Specifically, the second communication opening 300 extends from the symmetrical central plane 341 to a left side and a right side of the first connecting seam 301, which means that the second communication opening 300 is disposed above the middle position of the corner portion 34, as shown in FIGS. 6 and 7.

Additionally, the first wall 11 and the second wall 12 are essentially the same, with the only difference being the placement determined by the user during use. When the bed body 1 is flipped, function of the first wall 11 and function of the second wall 12 are effectively exchanged, and the first end 21 and the second end 22 correspondingly switch as well. Each of a portion where the first end 21 is connected to the first wall 11 and a portion where the second end 22 is connected to the second wall 12 forms a recessed area, which enhance friction between the bed body 1 and the ground, as well as between the bed body 1 and the human body, thereby improving stability and user comfort.

Obviously, the embodiments described above are only a part of the embodiments of the present disclosure, and not all of them. The accompanying drawings give some embodiments of the present disclosure, but do not limit the patentable scope of the disclosure, which may be realized in many different forms. Rather, these embodiments are provided for the purpose of providing a more thorough and comprehensive understanding of the present disclosure. Although the present disclosure has been described in detail with reference to the foregoing embodiments, it is still possible for a person skilled in the art to modify the technical solutions recorded in the foregoing specific embodiments or to make equivalent substitutions for some of the technical features therein. Any equivalent structure made by utilizing the contents of the specification and the accompanying drawings of the present disclosure, directly or indirectly applied in other related technical fields, are all the same within the scope of the patent protection of the present disclosure.

What is claimed is:

1. An inflatable bed, comprising:

a bed body, defining an inflation chamber and comprising a first wall and a second wall arranged opposite to the first wall; and at least one tension band, arranged in the inflation chamber, wherein each of the at least one tension band comprises a first end, a second end, and at least one connecting section connected between the first end and the second end; the first end is connected to the first wall, the second end is connected to the second wall, each of the at least one connecting section has at least one narrow portion, and a width of at least a portion of each of the at least one narrow portion is smaller than each of a width of the first end and a width of the second end;

wherein each of the first end and the second end extends along a first direction; each of the at least one connecting section extends from the first end to the second end along a second direction perpendicular to the first direction; each connecting section, each narrow portion, the first end, and the second end has a width; the width is a size of the connecting section, the narrow portion, the first end, and the second end in a third direction perpendicular to the first direction and perpendicular to the second direction; the width of the narrow portion in each of the at least one connecting section is less than the width of the second end and less than the width of the first end.

2. The inflatable bed as claimed in claim 1, wherein the width of the at least a portion of the each of the at least one narrow portion gradually increases toward the first end, and the width of the at least a portion of the each of the at least one narrow portion gradually increases toward the second end.

3. The inflatable bed as claimed in claim 1, wherein each of the at least one narrow portion defines at least one notch.

4. The inflatable bed as claimed in claim 3, wherein the number of the at least one notch is two, one of the two notches is formed in one of two sides of the each of the at least one narrow portion which are arranged opposite to each other, the other of the two notches is formed in the other of the two sides, and the two notches are symmetrically distributed in a mirror-image configuration.

5. The inflatable bed as claimed in claim 1, wherein the each of the at least one narrow portion is located at a middle portion of a respective one of the at least one connecting section, and a distance between the each of the at least one narrow portion and the first wall is substantially equal to a distance between the each of the at least one narrow portion and the second wall.

6. The inflatable bed as claimed in claim 1, wherein the number of the at least one connecting section is two, and each of the first end and the second end is connected to each of the two connecting sections;

the each of the at least one tension band is in an annular shape, and the two connecting sections, the first end, and the second end cooperatively form a respective one of the at least one tension band;

a part of each of the two connecting sections is recessed to form the at least one narrow portion.

7. The inflatable bed as claimed in claim 6, wherein the each of the at least one tension band is a one-piece structure.

8. The inflatable bed as claimed in claim 1, wherein the number of the at least one tension band is more than one, and the more than one tension band is arranged along a length direction of the bed body.

9. The inflatable bed as claimed in claim 1, wherein:

the bed body further comprises an enclosure wall connected with the first wall and the second wall, and the enclosure wall, the first wall, and the second wall cooperatively define the inflation chamber;

the inflatable bed further comprises at least one side band, the at least one side band is located in the inflation chamber and is arranged in a closed annular shape; each of the at least one side band comprises a first connection edge and a second connection edge, the first connection edge is connected to the enclosure wall, and the second connection edge is connected to the first wall or the second wall; the at least one side band, the enclosure wall, and the first wall cooperatively define a secondary air cavity, or the at least one side band, the enclosure wall, and the second wall cooperatively define the secondary air cavity; each of the at least one side band defines at least one first communication opening, and the at least one first communication opening is configured to communicate the inflation chamber with the secondary air cavity.

10. The inflatable bed as claimed in claim 9, wherein;

the bed body is in a polyhedral shape, each of the at least one side band has a plurality of inner corners, and the number of the plurality of inner corners corresponds to the number of sides of the bed body;

the each of the at least one side band includes a plurality of corner portions, with at least one of the plurality of corner portions located at each of the plurality of inner angles, and the at least one first communication opening is defined in at least one of the plurality of corner portions.

11. The inflatable bed as claimed in claim 10, wherein each of the plurality of corner portions has the at least one first communication opening.

12. The inflatable bed as claimed in claim 10, wherein each of the at least one first communication opening is arranged in an elliptical shape and is substantially located at a middle position of a respective one of the plurality of corner portions.

13. An inflatable bed, comprising:

a bed body, defining an inflation chamber and comprising a first wall and a second wall arranged opposite to the first wall; and at least one tension band, arranged in the inflation chamber, wherein each of the at least one tension band comprises a first end, a second end, and at least one connecting section connected with each of the first end and the second end; the first end is connected to the first wall, the second end is connected to the second wall, each of the at least one connecting section has at least one narrow portion, and a width of at least a portion of each of the at least one narrow portion is smaller than each of a width of the first end and a width of the second end;

an enclosure wall, connected with the first wall and the second wall, wherein the enclosure wall, the first wall, and the second wall cooperatively define the inflation chamber;

at least one side band, located in the inflation chamber and comprising: a first connection edge, connected to the enclosure wall; and a second connection edge, connected to the first wall or the second wall;

wherein:

the at least one side band, the enclosure wall, and the first wall cooperatively define a secondary air cavity, or the at least one side band, the enclosure wall, and the second wall cooperatively define the secondary air cavity;

a first connection seam is formed at a connection between the first connection edge and the enclosure wall, and a second connection seam is formed at a connection between the second connection edge and the first wall or the second wall;

at least one communication opening is defined in at least one of the first connection seam and the second connection seam, and the at least one communication opening is configured to communicate the inflation chamber with the secondary air cavity.

14. The inflatable bed as claimed in claim 13, wherein the at least one communication opening is defined in the first connection seam.

15. The inflatable bed as claimed in claim 13, wherein;

the bed body is in a polyhedral shape, each of the at least one side band includes a plurality of corner portions, and the number of the plurality of corner portions corresponds to the number of sides of the bed body;

the at least one communication opening is defined in at least one of the plurality of corner portions.

16. The inflatable bed as claimed in claim 15, wherein each of the plurality of corner portions defines the at least one communication opening.

17. The inflatable bed as claimed in claim 15, wherein each of the at least one side band defines at least one another communication opening, and the at least one another communication opening is configured to communicate the inflation chamber with the secondary air cavity; the at least one another communication opening is arranged through a symmetrical central plane of a respective one of the plurality of corner portions.

18. The inflatable bed as claimed in claim 9, wherein the number of the at least one side band is two, one of the two side bands is connected to the first wall, and the other of the two side bands is connected to the second wall.

19. The inflatable bed as claimed in claim 1, wherein the at least one connecting section is connected an edge of the first end and an edge of the second end corresponding to the edge of the first end; each of the at least one connecting section has two opposite side edges; each of the two opposite side edges of the connecting section is recessed in the third direction to form the at least one narrow portion.

* * * * *